United States Patent [19]

Lancaster et al.

[11] Patent Number: 4,524,568

[45] Date of Patent: Jun. 25, 1985

[54] POWER ASSISTED ROTATABLE FILM WRAPPING APPARATUS

[75] Inventors: Patrick R. Lancaster; William G. Lancaster, both of Louisville, Ky.

[73] Assignee: Lantech, Inc., Louisville, Ky.

[21] Appl. No.: 411,995

[22] Filed: Aug. 27, 1982

[51] Int. Cl.[3] ..... B65B 13/04

[52] U.S. Cl. ..... 53/556; 53/588; 53/441

[58] Field of Search ..... 53/441, 556, 588, 210

[56] References Cited

U.S. PATENT DOCUMENTS

| | | | |
|---|---|---|---|
| 4,050,220 | 9/1977 | Lancaster | 53/588 X |
| 4,302,920 | 12/1981 | Lancaster | 53/556 X |
| 4,317,322 | 3/1982 | Lancaster | 53/588 X |
| 4,387,552 | 6/1983 | Lancaster | 53/556 |

*Primary Examiner*—John Sipos

*Attorney, Agent, or Firm*—Gipple & Hale

[57] ABSTRACT

A rotatable film wrapping apparatus for wrapping a load on a conveyor with an overwrap of stretched plastic film web, having a film web pre-stretching mechanism which is provided with a constant torque by a power assistance mechanism. The power assistance mechanism comprises a stationary ring adjacent a rotary ring on which the film roll and pre-stretch mechanism are mounted, and a friction roller on the rotary ring which contacts the stationary ring to transfer rotational energy to the pre-stretch device as the rotary ring rotates. The pre-stretch mechanism comprises a downstream roller across which the film is drawn to the load at a speed which varies, and an upstream roller linked by gears to the downstream roller so that the upstream roller rotates at a fixed fraction of the speed of the downstream roller to stretch film between the rollers. The energy of the friction roller is transferred through an adjustable constant torque device to the pre-stretch mechanism without controlling the speed of the pre-stretch mechanism, and since a constant torque is added to the pre-stretch mechanism, the force on the film to the load can be substantially reduced while allowing the pre-stretch drive to speed up and slow down according to the film demand from corners or changing load size. This permits higher levels of stretch, faster payout speeds, and use of less uniform film than were thought possible previously. Relatively centered loads with minimum corner protrusion may be wrapped without the constant torque device by a proper selection of gears such that the downstream roller surface speed is driven slightly below the average relative surface speed of the load.

25 Claims, 14 Drawing Figures

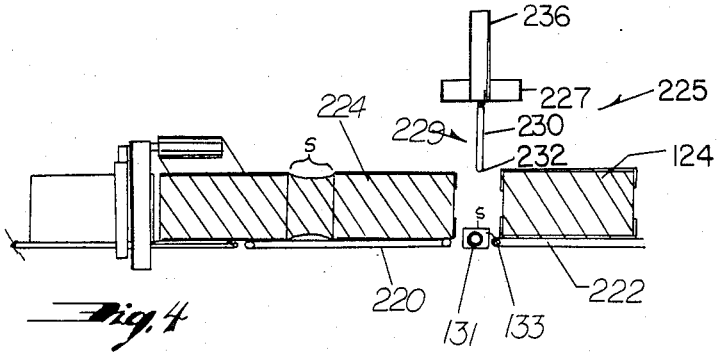
Fig. 4
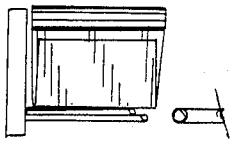
Fig. 5
Fig. 6
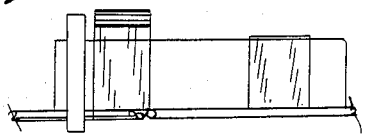
Fig. 7
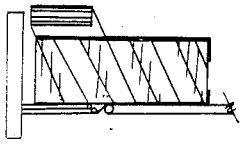
Fig. 3
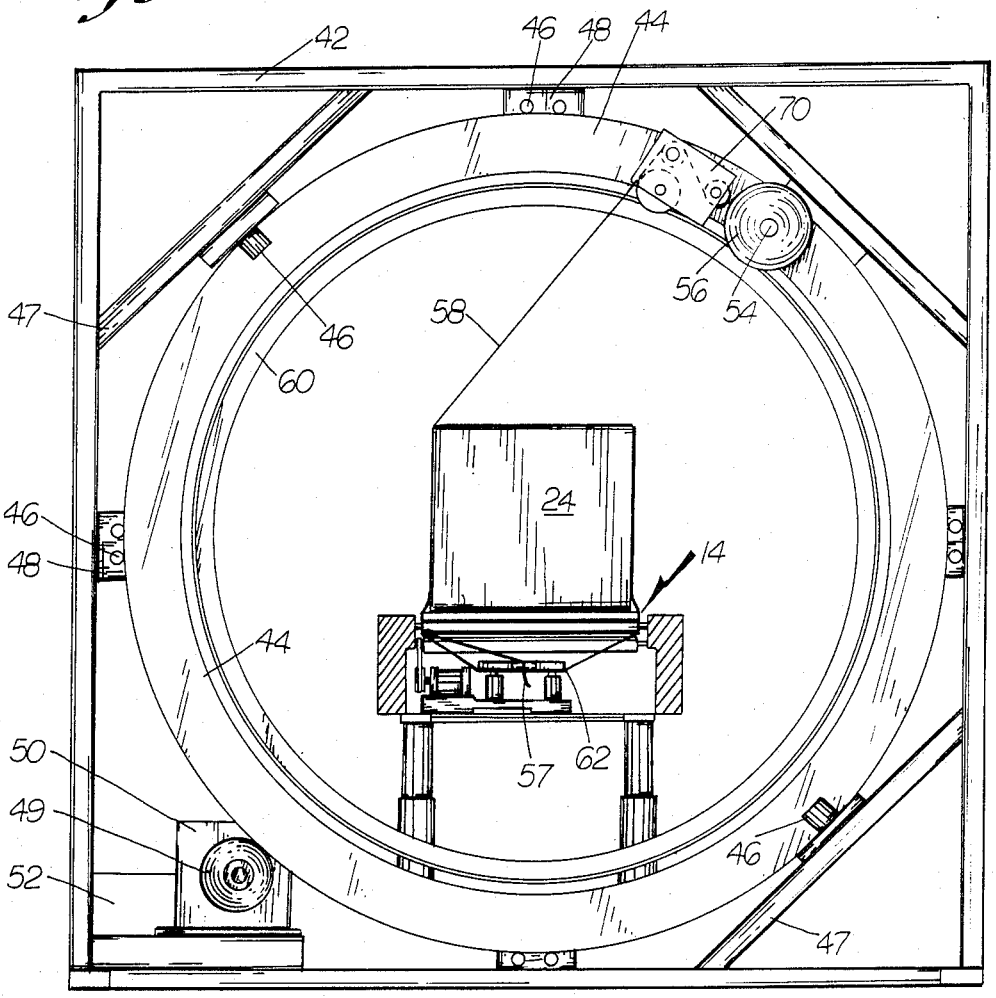

POWER ASSISTED ROTATABLE FILM WRAPPING APPARATUS

BACKGROUND OF THE INVENTION

The present invention generally relates to packaging and more particularly is directed to a rotating stretch wrapping apparatus for making unitary packages which hold a plurality of components, each package containing a load wrapped in a web of stretched film.

Case packing or boxing is a common way of shipping multiple unit products. Multiple unit products are generally stacked in a corrugated box or are wrapped with kraft paper with the ends of the kraft paper being glued or taped.

Some manufacturers use strapping of vertical steel or plastic binding to unitize the product. The problems incurred in the use of strapping are the requirement of costly corner protectors, danger of bending or snapping and injuring the operator while applying this high tension material to the loads, the ever present problem of settling due to moisture wetting the cartons, and the sides bulging or normal vibrations causing the straps to loosen and the load to come apart.

Glue is an alternative method used in some areas, but customer dissatisfaction with gluing is high because removal of glued cartons or bags from the unitized loads tends to tear outside layers of the cartons. Glue, although an inexpensive material, demands interleaving for product orientation and thus requires more durable and expensive packaging material.

Because of the lack of alternatives of packaging, tape is currently being used to horizontally bind the top layer of the load. However, tape is expensive and allows relatively free movement of all products surrounded.

Another way of shipping products is by putting a sleeve or covering of heat shrinkable material around and products and shrinking the sleeve to form a unitized package. The use of heat shrinkable film is described in U.S. Pat. Nos. 3,793,798; 3,626,645; 3,590,549 and 3,514,920. A discussion of this art is set forth in U.S. Pat. No. 3,867,806.

An economical way of packaging products is by wrapping the product load with a web of stretched plastic film.

The elasticity of the stretched plastic film holds the products of the load under more tension than either shrink wrap or kraft wrap, particulaly with products which settle when packaged. The effectiveness of stretched plastic film in holding a load together is a function of the containment or stretch force being placed on the load and the ultimate strength of the total layered film wrap. These two functions are determined by the modulus or hardness of the film after stretch has occurred and the ultimate strength of the film after application. Containment force is currently achieved by maximizing elongation until just below a critical point where breaking of the film occurs.

The use of wrapping machinery to wrap stretched film around a load is well known in the art. Four types of stretch wrapping apparatus are commonly used in the packaging industry and these types are generally described as spiral rotary machines, full web rotary machines, passthrough machines, and circular rotating machines.

A typical spiral machine is shown in U.S. Pat. No. 3,863,425 in which film is guided from a roll and wrapped around a cylindrical load in a spiral configuration. A carriage drives the film roll adjacent the surface of the load to deposit a spiral wrap around the load and returns in the opposite direction to deposit another spiral overwrap around the load.

Spiral wrapping machines which are currently commercially available are manufactured by Lantech, Inc. under Model Nos. SVS-80, SVSM-80, STVS-80, STVSM-80 and SAHS-80.

A full web type of apparatus which wraps stretched film around a rotating load is disclosed in U.S. Pat. No. 3,876,806 assigned to Lantech, Inc. A similar full web apparatus using a tensioned cling film wrapped around a rotating load is shown by U.S. Pat. No. 3,986,611 while another apparatus using a tacky PVC film is disclosed in U.S. Pat. No. 3,795,086.

Full web wrapping machines typical of those presently commercially available are Model Nos. S-65, T-65 and SAH-70 manufactured By Lantech, Inc.

Another type of machine for wrapping a pallet load commonly called a passthrough machine is disclosed in U.S. Pat. No. 3,596,434. In this reference a pallet load is transported along a conveyor and the leading face of the pallet load contacts a vertical curtain of film formed by the sealed leading edges of film webs dispensed by two rolls of film on opposite sides of the path of the pallet load. The pallet load continues to move along the conveyor, carrying with it the sealed film curtain until the side faces of the pallet load as well as the front face are covered by film web. A pair of clamping jaws then close behind the pallet load, bringing the two film web portions trailing from the side faces of the pallet load into contact with one another behind the pallet. The jaws then seal the film web portions together along two vertical lines, and cut the web portions between those two seals. Thus, the film web portions are connected to cover the trailing face of the pallet load, and the film curtain across the conveyor is re-established to receive the next pallet load. The pallet load may subsequently be exposed to heat in order to shrink the film web thus applying unitizing tension to the load, as is disclosed in U.S. Pat. No. 3,662,512. Commercial passthrough machines are currently manufactured by Weldotron, Arenco, and SAT of France.

Various apparatus and processes have been developed to rotatably wrap stacked components to form a load.

Stationary loads which are brought to a loading area and are wrapped by a rotating member which dispenses stretched film around a load are disclosed in U.S. Pat. Nos. 4,079,565 and 4,109,445. U.S. Pat. No. 4,079,565 discloses a full web vertical wrap of the load while U.S. Pat. No. 4,109,445 discloses the horizontal spiral wrap of a load. U.S. Pat. No. 4,050,220 discloses a wrapping device for multiple unit loads. Each load is conveyed to a wrapping area in which a load is supported on one or more stationary planar surfaces. The leading edge of a roll of stretchable plastic wrapping material is held adjacent to the load, and the roll of material is rotated about the load and the supporting planar surfaces, wrapping the load and the supporting surfaces together. Plastic wrapping material is stretched during the wrapping operation so that the material is under tension when applied to the load. After the wrapping cycle is complete, the load is pushed past the ends of the supporting surfaces, and the wrapping material which covered the supporting surfaces collapses against the supported sides of the load. Further developments of this wrapping system are disclosed in U.S. Pat. Nos. 4,110,957 and 4,178,734.

U.S. Pat. No. 603,585 discloses a spiral wrapping device for enclosing individual newspapers in paper wrap for mailing purposes. Each newspaper is placed on a cylindrical core with a circumference approximately twice that of a newspaper, and each newspaper advances along the length of the core as the core is rotated. Wrapping paper is applied to the core at an angle and the wrapping paper between newspapers is severed as each newspaper reaches the end of the cylinder and is placed on a flat horizontal surface, thereby collapsing the wrapping paper against the underside of the newspaper previously pressed to the cylinder.

U.S. Pat. No. 1,417,591 discloses a wrapping machine for individual times such as boxes in which each such item is conveyed along the surface of a horizontal sheet of wrapping material. The edges of wrapping material on each side of an item are curled upward to meet one another atop the item to be wrapped thereby forming a tube around the item. The leading end of the tube is sealed and the trailing end of the tube is severed and then sealed to enclose the item. Another device which utilizes this system of wrapping is disclosed in U.S. Pat. No. 3,473,288.

In U.S. Pat. No. 2,575,467, a wrapper of cylindrical packages for material such as sausage is disclosed in which the package is rotated about its cylindrical axis as wrapping tape is applied at an angle to form a cylindrical wrap.

In U.S. Pat. No. 2,863,270 two cylindrical items of approximately equal diameter are abutted at their planar ends, and placed by hand in a cradle which exposes the complete circumference of the abutting ends. A roll of wrapping material is then driven by a hand crank mechanism to circulate around the circumference of the abutting ends, applying wrapping material thereto. When sealed together, the pair of cylindrical items are removed from the cradle by hand.

A spiral wrapping machine for long bundles of items such as filaments is disclosed in U.S. Pat. No. 3,000,167. As the bundle of filaments moves along its axis through the wrapping area, a ring circulates about the bundle carrying a roll of wrapping material which is applied to the bundle to form a spiral wrap pattern. Because the normal load of filaments or similar items is much longer than the wrapping area, it is not necessary to provide support for the bundle in the wrapping area, and therefore no support structure is wrapped with the bundle.

All of these prior art apparatuses suffer from a severe limitation which relates to cost per unit load for film unitization. Friction brake devices do not maintain a consistent stretch force on the film. These brake devices are subject to variation due to their physical construction, sensitivity to speed change caused by passage of load corners, and the resultant sudden acceleration and deceleration of film payout. A typical 40"×48" pallet load will incur a surface speed change of more than 40% with each quarter turn. Moreover, it can be appreciated that these speed changes are substantially discontinuous as film dispensed by relative rotation of the film roll around the load is intercepted by successive corners of the load. Higher rotation speed of 12–18 revolutions per minute produce additional resonating forces which change during payout and the resultant weight decrease of the film roll. Additional limitations on maximum elongation are caused by film roll imperfections and gauge variations which accentuate the force variations described above to produce film ruptures. Even though all of the films previously described carry manufactures specified elongation capabilities above 300%, these rates cannot be approached because of limitations imposed by friction-type brake devices.

Commercial circular rotating wrapping machines are presently manufactured by Lantech, Inc. under the trademark LANRINGER, and are provided with wrapping ring inner diameters of 36 inches, 54 inches, 72 inches, and 84 inches. In differentiating between the various circular rotating wrapping machines manufactured by Lantech, Inc., the manual model has the designation SR; the full web models have the designations SVR and SAVR; the multiple banding models have the designation SVBR and SAVBR; the spiral models have the designation SVSR and SAVSR, and the continuous wrap or bundler models have the model designtions SVCR and SAVCR.

U.S. Pat. Nos. 4,302,920 and 4,317,322, assigned to Lantech, Inc., discloses a pre-stretch film elongation system mounted adjacent a film roll and rotated about a stationary load. The pre-stretch system which is mounted on the rotating ring includes an upstream roller and a downstream roller across which the film web successively passes. The two rollers are speed coupled by gears, belts, or the like, which force a constant ratio of angular velocity between the rollers. Film is drawn from the film roll and across each of the rollers by relative rotation of the ring around the load. The fixed speed ratio between the upstream and downstream rollers, in which the downstream roller moves more quickly than the upstream roller, causes substantial stretching between the rollers of the web. However, it can be appreciated that the entire force exerted between the rollers is due to film being wrapped about the load. In this device the substantial changes in payout speed demand are transmitted directly from the load back through the web to the pre-stretch device, so that the level of force exerted on the film between the downstream roller and the load remains relatively constant.

SUMMARY OF THE INVENTION

An apparatus is disclosed for applying stretchable plastic film to pallet loads using a pre-stretching mechanism which is provided with a constant torque to supplement the force exerted by the film web being drawn through the pre-stretching mechanism during rotation of a film roll about a load. Because a constant torque is added to the pre-stretching mechanism, the speed changes required for the corners are transmitted directly to the pre-stretch mechanism allowing substantial reduction in force on the film required to drive the pre-stretch mechanism, which permits higher levels of stretch, faster payout speeds, and use of less uniform film than were previously thought possible. The present invention reduces the likelihood of load collapse and improves the film tolerance of irregular loads as the force on the film web between the downstream roller and the load is less than in the prior art.

In the apparatus a series of loads, each containing a plurality of units, are fed into a rotating wrapping apparatus having a film web stretching mechanism and film dispensing mechanism. The load is covered by a plurality of layers of stretched film to form a unitary package. The stretching mechanism and dispensing mechanism are mounted on a rotating ring through which a load travels to arrive at a wrapping station for encirclement by stretched film web. A stationary ring is positioned concentric the rotating ring on the opposite side of the rotating ring from the wrapping station. Torque is delivered to the film stretching mechanism during rotation of the rotating ring by way of a power assistance device comprising a friction roller mounted to the pivot axle of the film stretching mechanism. The friction roller contacts the stationary ring and revolves at a constant rate due to friction against the ring. The friction roller then transfers its energy through gear means to an adjustable constant torque device, which provides a predetermined constant torque to the film pre-stretching mechanism. The constant torque device allows the film stretching mechanism to operate at a varying speed determined by the web being drawn from the mechanism to the load, while contributing a portion of the force required to stretch the film, to reduce the force experienced by the load and the film between the second roller and the load.

Alternatively, where the load presents a substantially cylindrical cross-section, cornering creates only minimal force changes. In this case, the constant torque device may be eliminated and the film stretching mechanism driven at a constant speed by the friction roller. The speed is chosen to rotate the downstream roller at a speed slightly lower than the speed of film delivery to the load.

Thus, it can be seen that the invention provides a novel and useful improvement over the prior art rotating wrapping machines, both those utilizing brake stretching systems and those utilizing coupled roller stretching systems. This is advantageously accomplished without the need to transfer electrical power or control signals from a stationary source to devices such as brakes or motors on the rotating ring.

Most plastic films when stretched above their yield point gain significantly in modulus and ultimate strength. The typical polyethylene will multiply three times the ultimate strength in pounds per square inch of cross sectional area after being elongated approximately 300 percent. This significant increase in strength begins approximately when the yield point is exceeded in the elongation phase. Limitations of friction-based constant force devices prevent current stretch wrap applications from achieving the higher levels of containment force and ultimate strength available in the foremost plastic films. Achieving the higher elongation levels with the invention allows fewer revolutions of film with equivalent holding power. These higher levels of stretch not only allow fewer revolutions of film but also less film by weight for each revolution.

Thus, the present invention allows at least double the practical level of elongation currently experienced with prior art "brake" systems. This gives higher containment forces and/or lower film costs to the end user.

Furthermore, the invention allows for more precise control of elongation allowing the user to get maximum cost efficiency from high yield films, along with higher film strength or modulus achieved at higher levels of elongation.

The higher levels of elongation are achieved on the film in the present invention without disruptive or crushing forces on the load because of the mechanical advantage experienced between the pulling force to the pallet and the force between the rollers further supplemented by the constant torque assistance.

The novel construction in the invention provides for isolation of the film roll stretch forces which eliminates premature film failure from roll end damage or roll down of edges under force. The use of this simplified construction eliminates the use of friction brakes and the problems of those brakes such as speed variation, break away from stop position, temperature variation, wear and operator control meddling.

The use of the film web for speed control as opposed to motor driven devices also eliminates the need for compensation devices for corner passages, length/width variation or roller rotation speed variation, as well as eliminating tension compensation devices.

It can thus be seen that the present invention provides a unique apparatus and process in that two rollers interconnected for constant speed ratio are speed-controlled by film drawn to a load. The film is stretched beyond its yield point as it accelerates between the rollers. A constant portion of the force is provided by film drawn to the load, and an additional constant portion of the force is provided by the power assistance device. Higher forces achieved during pre-stretch are slightly relieved between the downstream roller and the load producing inelastic strain recovery since the film is stretched above its yield point. The present invention essentially eliminates the neck down of the film web normally experienced at high elongation rates. By limiting the stretching action to a minimum distance between the rollers and avoiding secondary stretch between the second roller and the load, web neck down is significantly reduced.

Although the invention is set forth in claims, the invention itself and the method by which it is made and used may be better understood by referring to the following description taken in connection with the accompanying drawings forming a part hereof, in which like reference numerals refer to like parts throughout the several views and in which:

BRIEF DESCRIPTION OF THE DRAWINGS

FIG. 3 is an enlarged front elevational view of the invention shown in FIG. 1;

FIG. 4 shows a continuous spiral bundling system with a sequence of consecutive packages wrapped by the invention;

FIG. 5 discloses a full web mode of wrap accomplished by the inventive apparatus;

FIG. 6 discloses a banding mode of wrap accomplished by the inventive apparatus;

FIG. 7 discloses a spiral mode of wrap accomplished by the inventive apparatus;

DETAILED DESCRIPTION OF THE DRAWINGS

Figure 1:
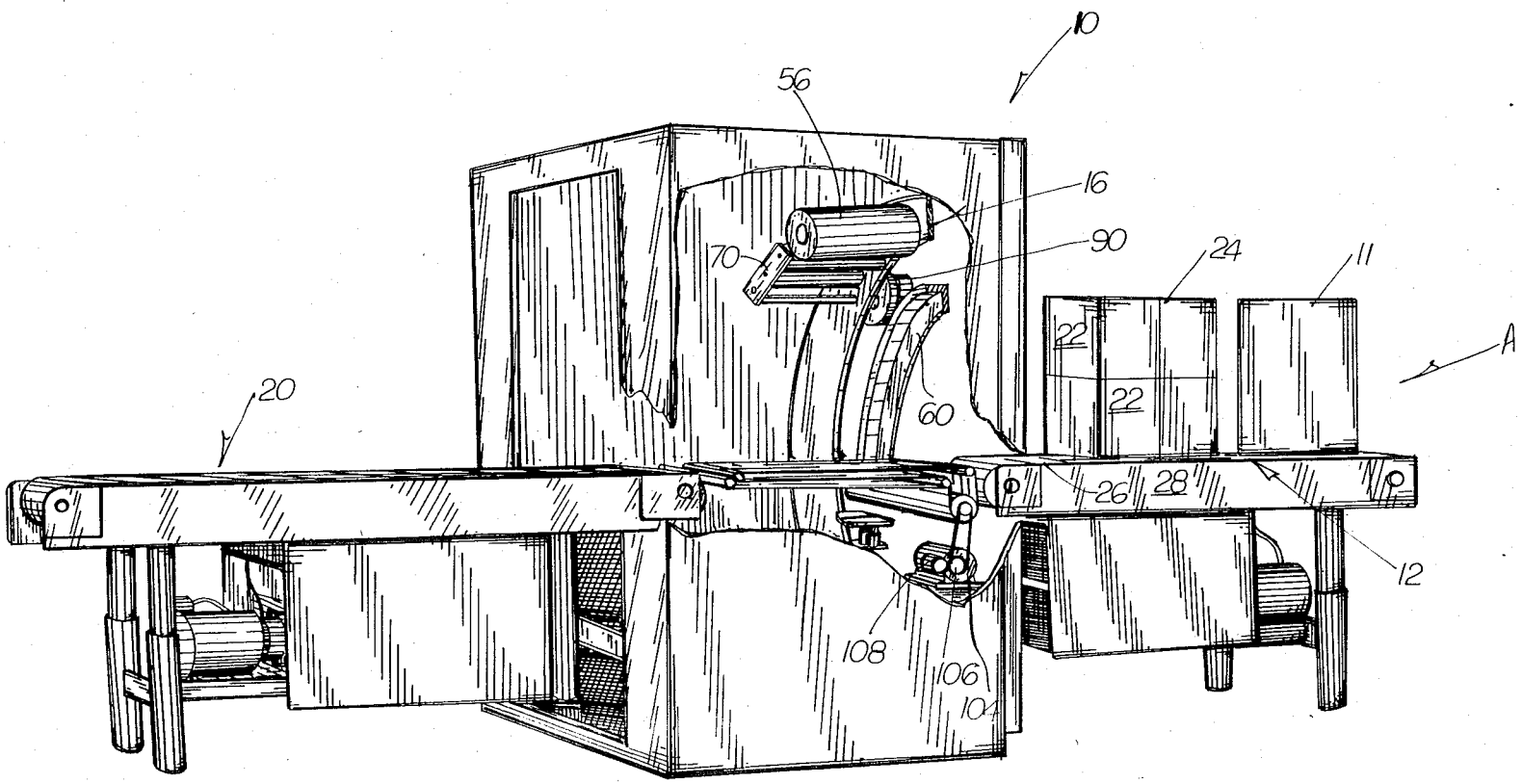
FIG. 1 discloses a perspective view of the invention partly broken away disclosing the inventive apparatus.

The best mode and preferred embodiment of the present invention is disclosed in FIGS. 1 through 3, 10 and 11, and shows a ring wrapping apparatus 10 comprising a feed conveyor 12, a wrap and load conveyor assembly 14, a film dispensing mechanism 16 with a cutting mechanism 18 and a take-off conveyor 20.

As shown in FIG. 1, a plurality of cartons 22 forming a load 24 have been loaded in a stacked relationship on an infeed conveyor assembly 12 by either manual or mechanical means. It should be noted that the load, depending on its nature and composition, may or may not require spacing. The loading device 11 is schematically shown and may be one of a number of types of stacking or placing devices which are well known in the art to place a stack of cartons or materials into designated areas.

In the preferred embodiment, the load 24 is placed on an infeed conveyor 12 which is comprised of an endless belt 26 mounted on frame support 28.

An alternate embodiment of the infeed conveyor could take the form of a hydraulic or pneumatic pushing device (not shown) which can be used to engage each load 24 with a platen to push the load into the wrapping area. However, the conveyor embodiment is preferred and the belts of the conveyor of the present invention are preferably textured so that they have a high coefficient of friction.

Figure 2:
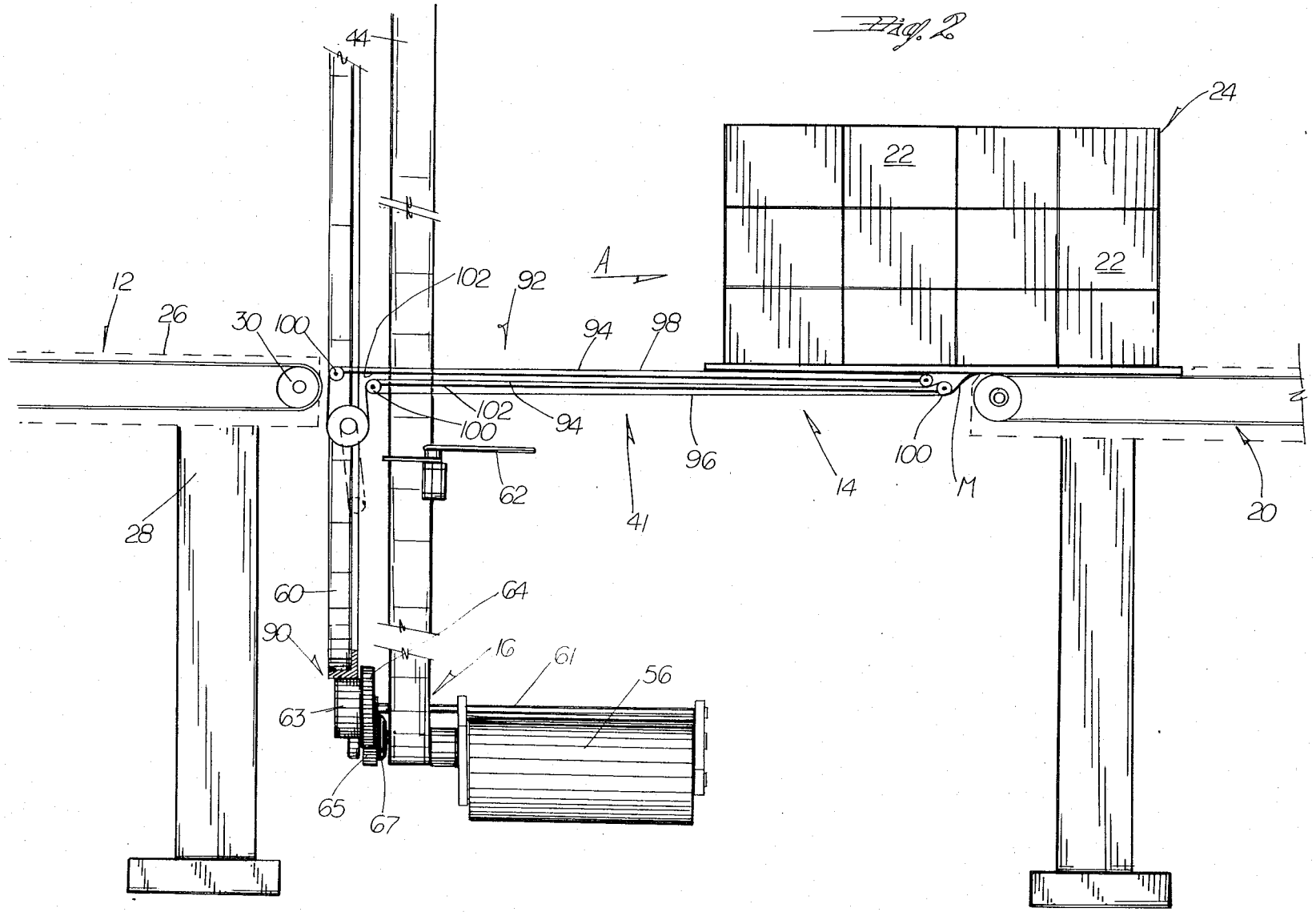
FIG. 2 discloses an enlarged reversed side elevational view of the invention as shown in FIG. 1.

The particular arrangement of the conveyors set forth in FIGS. 1 and 2 lends itself to random variation of total load size in all three dimensions. It is apparent however that other configurations could be constructed which would be advantageous for specific products. Thus, the conveyance of 12 packs or 6 packs of cans or bottles could be handled by a horizontal conveyor with guide conveyors on each side.

The conveyor belt 26 as seen in FIG. 2 is mounted on rollers 30 which are rotatably journalled by suitable bearing means in brackets which are secured to the frame support 28. The infeed conveyor 12 carries the loads 24 onto a wrapping station 41 comprising a film dispensing apparatus 16, and a wrapping conveyor assembly 14.

The preferred embodiment and best mode of the invention comprises a frame 42 on which a steel "donut" or ring-shaped film support member 44 is rotatably mounted and supported on three planes by guide rollers 46. If desired, the film support member can be constructed of aluminum. A plurality of guide rollers 46 project inward from the frame 42 on arms 47 and mounting plates 48 to engage the ring-shaped member so that it can be driven in a predetermined path. A friction drive wheel 49 is positioned adjacent the ring member 44 at its base and engages the member 44 to rotate the member 44 within the guide wheel rolling area. The friction drive wheel 49 is driven by a motor 50 having a shaft which is suitably connected with a drive reducer 52. A material roll dispensing shaft 54 is rotatably secured to the ring member 44 for rotation on its axis and is adapted to receive and hold a roll of film material 56. A stationary ring 60 concentric with and parallel to ring member 44 is fixed to frame 42 on a side of ring member 44 opposite that of film roll 56.

Typical films which can be used in the stretch wrapping apparatus are EVA copolymer films with a high EVA content such as the films manufactured by Consolidated Thermoplastics "RS-50", Bemis "Super-Tough", and PPD "Stay-Tight" films. PVC films such as Borden Resinite "PS-26" can be used in the invention along with premium films such as Mobil-X, Presto premium and St. Regis which utilize a new low pressure polymerization process resin manufactured by Union Carbide and Dow Chemical Company. This resin, called linear low density polyethylene, has significantly different stretch characteristics than previous stretch films. These characteristics allow the film to withstand the high stress of extreme elongation without tearing during wrapping of the load.

It should be noted that film, film material and film web are used interchangeably throughout the specification.

The film web is passed through a pre-stretching or elongation mechanism 70 and is tucked or fastened underneath the load or held in clamp assembly 62. The pre-stretching mechanism 70 which is best seen in FIGS. 1, 3, 10 and 11, comprises connected roller members 72 and 74 which are rotatably mounted on respective shafts 73 and 75 which are in turn journalled into a housing 76. The housing 76 is rotatably mounted on a pivot axle 61 journalled to the ring member 44. The rollers 72 and 74 are connected together by gears 77 and 79 which mesh together and are driven as the film web engages the rubber roller surfaces driving the rollers. The gears 77 and 79 operate so that the film web passes first across the upstream roller 72 and then across the downstream roller 74 as it is pulled from film roll 56 to the load 24, and the film web drives the downstream roller 74 at a faster rate than the upstream roller 72, causing the film to be accelerated and stretched in a narrow space 80 between the two rollers. The ratio of the gear 77 to the gear 79 preferably ranges from 4:5 to 1:4. The pre-stretching mechanism 70 is pivotable on pivot axle 61 so that upstream roller 72 is normally urged against film roll 56 in any well-known conventional manner such as by a coil spring (not shown), which maintains contact of upstream roller 72 and film roll 56 as film payout reduces the diameter of film roll 56. Contact of roller 72 and roll 56 prevents uncontrolled payout of film web due to momentum of film roll 56 upon sudden deceleration of roller 72.

Figure 10:
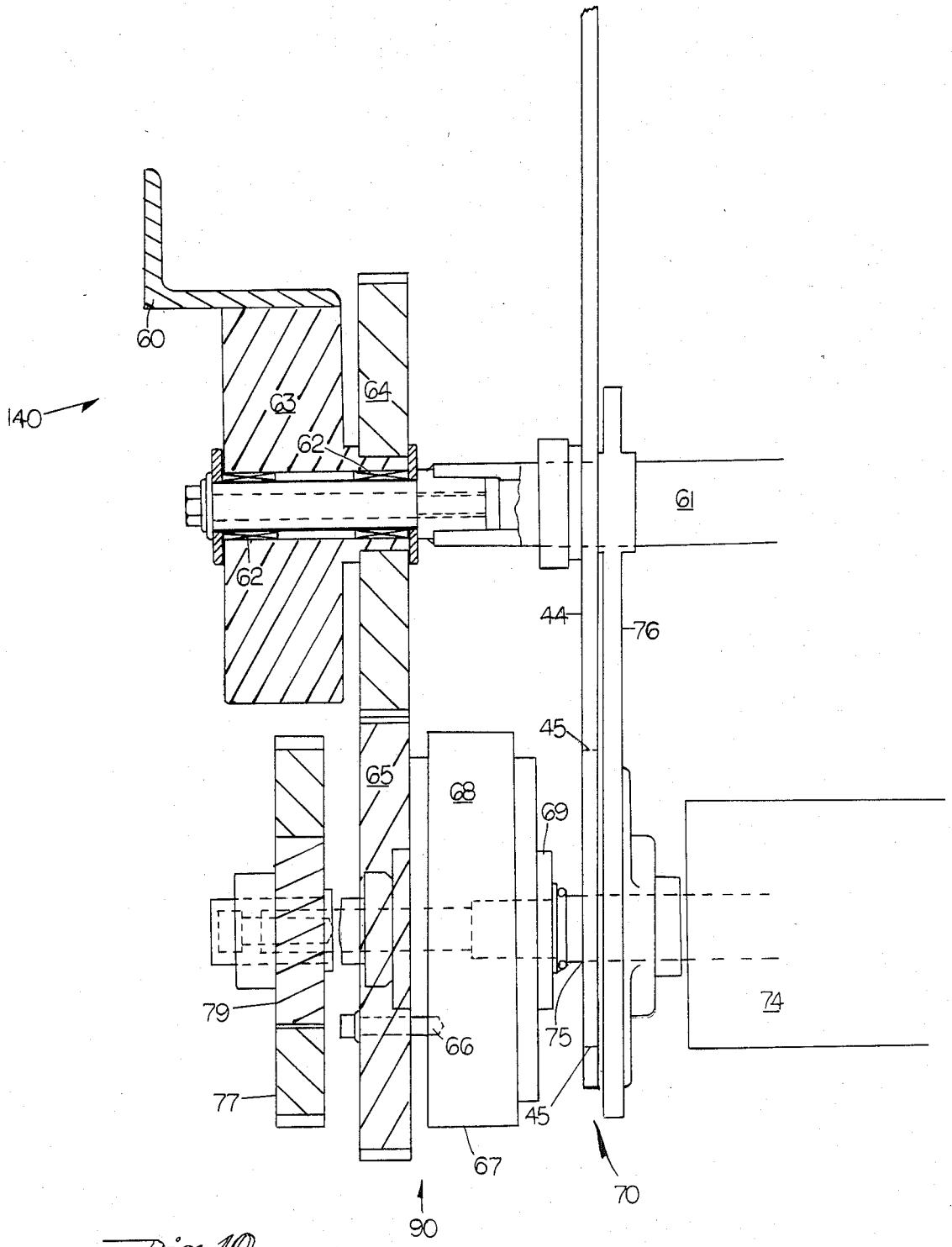
FIG. 10 is an isolated enlarged side view of the pre-stretching mechanism of the invention.
Figure 11:
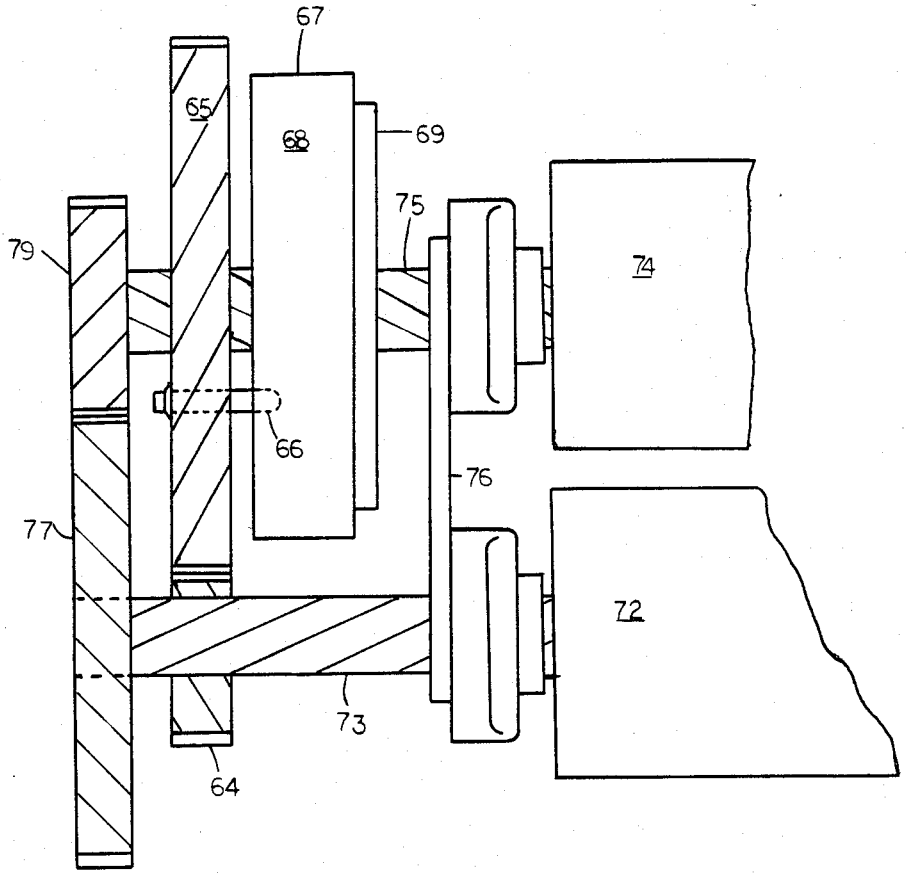
FIG. 11 is a bottom view of the apparatus of FIG. 10.

Power assistance assembly 90 is best understood by referring to FIGS. 10 and 11. Shafts 61, 73 and 75 extend through housing 76 and ring 44 a distance at least equal to the distance between rotary ring 44 and stationary ring 60. Shafts 73 and 75 pass through a slot 45 defined in ring 44, so that shafts 73 and 75 may pivot around shaft 61. The power assistance assembly included a power transfer assembly 140 comprising a contact or friction roller 63 mounted on the end of pivot axle 61 so as to contact the surface of stationary ring 60. Contact of ring 60 and roller 63 is maintained throughout the revolution of the moving "donut" or ring 44 because rings 44 and 60 are concentric. Roller 63 is preferably made of rubber or another material with resilience and a high coefficient of friction against the material of ring 60, which is preferably metal. The resilience of roller 63 compensates for any minor errors in alignment or shape of rings 60 and 44. The friction of roller 63 against the ring 60 causes roller 63 to freely rotate about pivot axle 61 on bearing races 62 while ring 44 is rotated. This frictional engagement avoids the more expensive alternative of placing gear teeth around the surface of ring 60, and replacing roller 63 with a gear to mesh with ring 60. Roller 63 is locked in rotation with transfer gear 64, both of which free wheel about pivot axle 61.

Transfer gear 64 meshes with clutch gear 65 which free wheels on downstream gear shaft 75, which also extends through housing 76. An adjustable constant torque device 67 is mounted on shaft 75 adjacent gear 65, and a pin 66 is provided to lock gear 65 to the input plate 68 of constant torque device 67. The output plate 69 of constant torque device 67 is locked to shaft 75 and rotates with downstream roller 74.

The adjustable constant torque device 67 is preferably a hysteresis clutch such as model HCG-1 available off-the-shelf from Dana Industrial of Webster, Mass. Such devices accept an input rotation through the input plate 68 and supply an adjustable constant torque through the output plate 69. The amount of constant torque may be adjusted prior to wrapping by manipulation of built-in controls attached to device 67. The speed at which output plate 69 is rotated is independent of the speed at which input plate 68 is rotated, so that rotational speed of output plate 69 is determined by the speed at which film is drawn across roller 74 by rotation about the load. However, because energy is developed by roller 63 and transferred through gears 64 and 65 to torque device 67, the output plate 69 supplies a portion of the torque necessary to drive rollers 74 and 72, and the portion supplied is a constant regardless of ring speed or load size. Thus, the force to the load is reduced, and held relatively constant regardless of load size or corner passage.

It will be appreciated that gears 64 and 65 remain meshed as the housing 76 pivots on pivot axle 61, because the pivot axle 61 and the downstream roller shaft 75 remain at a constant distance from one another during pivoting. Therefore, torque is provided by the constant torque device 67 regardless of the pivoted position of housing 76 or the diameter of film roll 56.

Because loads of substantially cylindrical cross-section draw film at a substantially constant rate with minimal force variations on film web 58 between rollers 72 and 74, the power assistance assembly 90 may be modified for these loads by coupling of clutch gear 65 directly to roller 74. This can be accomplished by locking or splining gear 65 to shaft 75, or by locking input plate 68 to output plate 69. Thus, the roller 74 is forced to rotate at the speed of gear 65. This effectively eliminates the torque device 67 from power assistance assembly 90.

The wrapping conveyor assembly 14 as best seen in FIGS. 1 and 2 comprises two stacked conveyors 92 and 94. These conveyors are standard plate-type conveyors well known in the art comprising driven endless belts 96 and 98 mounted on a plurality of rollers 100. The rollers are supported by plates 102 secured in turn to a frame member (not shown) which holds the rollers in a rotatable position. The endless belt 96 is rotated in a direction A shown by the arrow in FIG. 2 and frictionally engages the top surface of endless belt 98 to drive it at the same speed. Belt 98 is driven by a motor assembly 104 shown in FIG. 1 which is connected by gear means 106 and linkage 108 in the form of chains or belts to drive the conveyors. The upper belt segment of conveyor 94 travels downstream with the lower segment travelling upstream. The upper belt segment of conveyor 92 travels upstream while the lower segment travels downstream. The upper and/or lower conveyor can comprise multiple belts.

This construction allows a web of film to be wrapped around a load 24 which was carried from the infeed conveyor 12 onto the wrapping station 41. The stretched wrap of web is wrapped around the conveyor assembly 14 and the load with both the load and wrap being carried by the conveyor assembly in the same direction. In the full web, spiral and banding modes, the conveyor assembly and wrapping ring is stopped, the clamp apparatus 62 clamps the film web and the cutter mechanism 18 severs the film web. The conveyor assembly 14 is activated carrying the load and the wrap downstream to a take-off conveyor 20. When the load encounters the take-off conveyor 20 as shown in FIG. 2, the elongated stretched web coming off of the end of the conveyor assembly assumes its memory position M against the load in the space between the conveyor assembly 14 and take-off conveyor 20, allowing the contained load covered by stretched wrap to be carried away.

Figure 8:
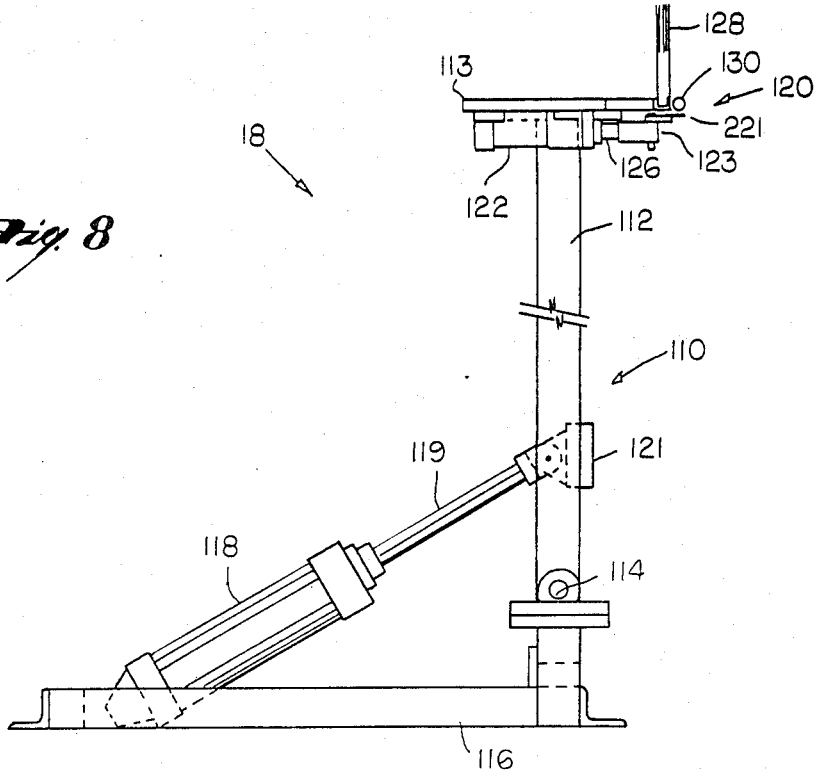
FIG. 8 discloses a side elevational view of a web severing mechanism used in the invention.
Figure 9:
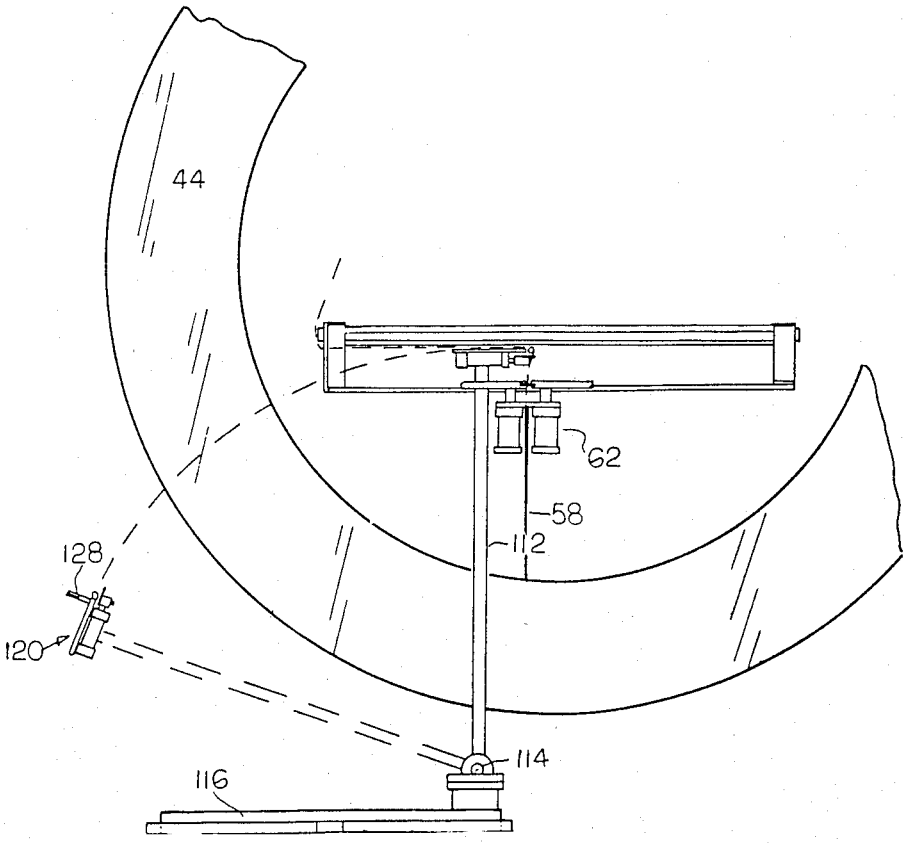
FIG. 9 discloses a front elevation view of the web severing mechanism shown in different positions during cutting of the film web.

As shown in FIGS. 8 and 9, the cutting mechanism 110 used in the preferred embodiment and best mode of the invention incorporates a driven pivoted standard which is adapted to project upward to engage the film web between clamping apparatus 62 and the load 24. The cutting mechanism 110 comprises a support standard 112 which is pivotally mounted at 114 to a base member 116. The base member 116 can either be a part of frame 42 or be secured to frame 42. A pneumatic lifting cylinder 118 has one end mounted by a suitable ear or bracket attachment to the base member 116 with the end of its piston rod 119 attached to the support standard 112 by suitable means such as a yoke member 121. Upon activation of the pneumatic cylinder, the upright standard 112 is transported in an arcuate path into the film web 58. Mounted to the support standard is a cutting assembly 120 comprising a support plate 113, a pneumatic cylinder 122 mounted to the support plate 113, and a cutting blade assembly 123 mounted to the piston rod 126 of cylinder 122. A brush 128 is vertically mounted on the support plate to brush down the trailing edge of the web against the conveyor assembly. A bumper member 130 is positioned in front of brush 128 to protect the brush base from initial contact with the film web and conveyor assembly. Upon appropriate activation, as for example a predetermined number of revolutions of the ring member, which is sensed by an appropriate sensor device, the cutting mechanism 110 is propelled upward so that the cutting assembly 120 engages the film web. The blade assembly 123 subsequently severs the film web from the load. If desired, the cylinder 118 can be activated after cutting to propel the standard 112 forward a predetermined distance causing the brush 128 to engage the remainder of the trailing edge of the film web and wipe it against an underlying film layer.

The conveyor assembly 14 leads from the infeed conveyor 12 to a take-off conveyor 20 which is constructed like the infeed conveyor and runs at the same speed as the infeed conveyor. In order to control both conveyors at the same rate of speed, a suitable mechanical means (not shown) is set up to make the drive of both the infeed conveyor and the take-off conveyor equal to the reduction gearing assembly of the drive motor. Thus, if the motor slows down or speeds up to drive the wrapping mechanism at different speeds, the infeed and take-off conveyors are simultaneously speeded up or slowed down so that the load is moved to conveyor assembly 14 and taken away from the conveyor assembly 14 at consistent relative speed.

In an alternate mode of wrapping, continuously wrapped loads are taken off of the apparatus and are severed into separate loads away from the apparatus. In this embodiment, the take-off conveyor 220 carries the continuously spiral wrapped loads as shown in FIG. 4 connected together by the film overwrap from the wrapping station. The take-off conveyor assembly 220 carries the spirally wrapped bundle onto cutting conveyor 222.

The wrapped spiral bundle 224 as seen in FIG. 4 is severed into individual packages by a guillotine-like cutting apparatus 225 comprising a frame 227 and a cutter mechanism 229 slideably mounted to the frame. The cutter mechanism 229 consists of a bow frame 230 strung with high nichrome wire 232 which is electrically connected to a source of energy. The resistance of the wire causes sufficient heat so that when the wire is reciprocated between the encapsulated loads 224 to cut them apart, the film material is simultaneously bonded to the edges so that the film will not unravel in shipment. As the wrapped loads 124 of the spiral bundle 224 enters the cutting area, a sensor 131 projects a light source through the transparent film in a space S between the individual loads against a reflector 133 to generate an electrical signal commanding the cutter blade drive circuitry to activate a pneumatic cylinder 236. Upon activation, the hot cutter wire 232 is driven through the film to sever the load 124 from the wrapped spiral bundle 224. Such sensing apparatus are well known in the art, and any standard circuit can be used to cause the pneumatic cylinder 236 to be activated when the sensor senses a space between loads 124. Likewise, a limit switch, contact switch, pressure sensitive switch or other suitable means can be used to activate the cylinder 236. In operation the bow 230 is driven downward during one cut and driven upward on the next cut to provide smooth, efficient operation.

The wire is heated by connecting it to a current source of about nine volts which heats the wire sufficiently so that the edges of the film are bonded to form a holding edge. The severed edge stretches back to its original memory shape to form the holding shape. The spiral bundle advances and the next spacing S between the loads 124 is sensed by the light sensor 131. The cutting wire 232 which has been previously driven down is lifted upward severing the wrapped loads in the same manner as previously discussed.

Other cutting apparatus can be used in place of the heating cutting wire, namely a knife blade with sawtooth edges secured to the frame in place of the cutter wire. When the blade is driven against the film, the cutting edge strikes the wrapping material substantially causing the wrapping material to shear. The cutting is done while the wrapped bundle is being transported by the conveyors.

Figure 12:
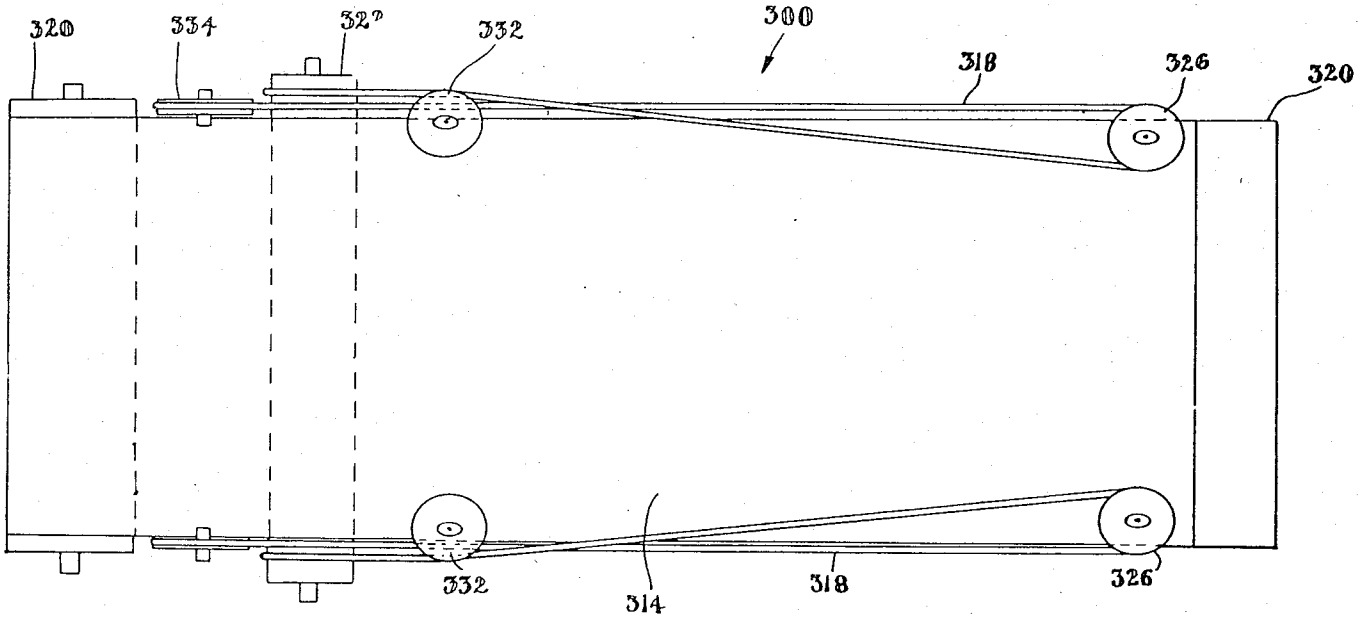
FIG. 12 is a top plan view of an alternate embodiment of the conveyor assembly of the invention.
Figure 13:
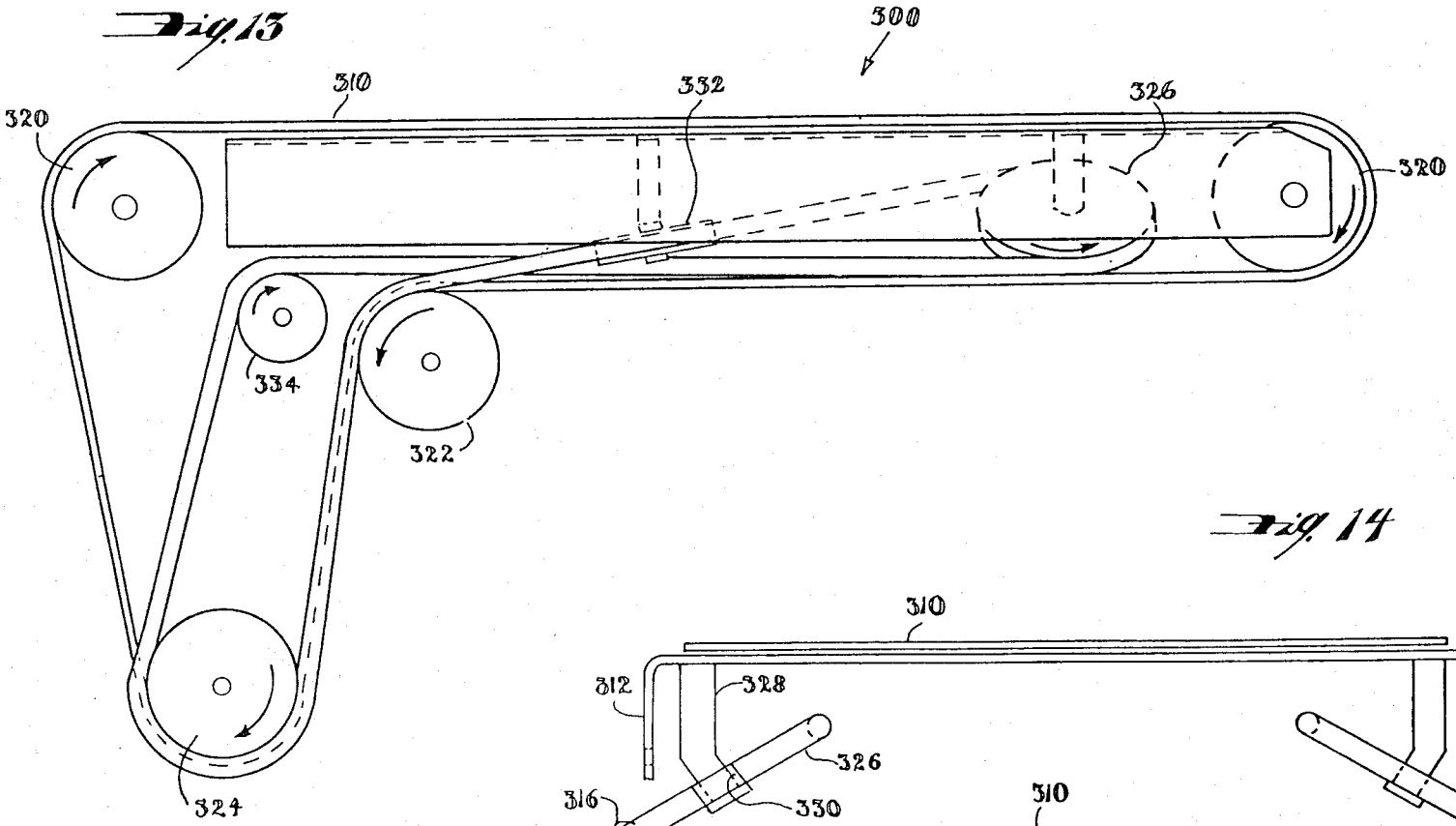
FIG. 13 is a side elevational view of the apparatus of FIG. 12.
Figure 14:
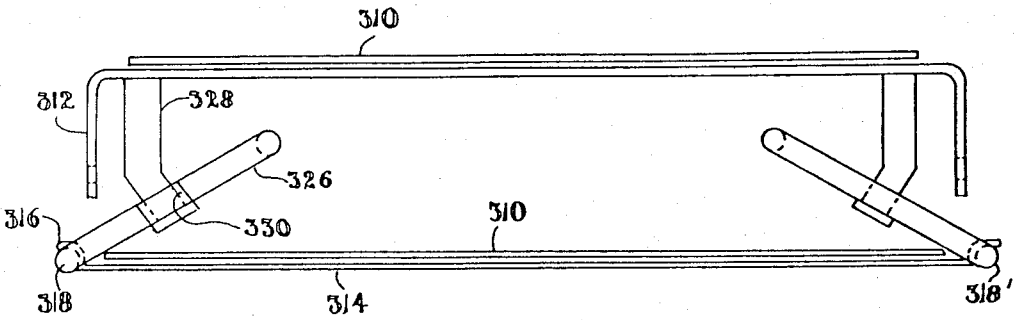
FIG. 14 is a front cross-sectional view taken along line 13'—13' of FIG. 13.

An alternate conveyor assembly embodiment 300 can be used in place of the conveyor assembly previously disclosed. In this embodiment, the load carrying belt 310 as shown in FIGS. 12–14 is positioned over a steel slider bed 312 which can be suitably mounted to a frame or upstanding supports. Also secured to the frame or supports are a steel base plate 314 with guide rails 316 formed on each side to form channels to contain the round belt 318. The belt 318 is of a standard commercial type well known in the art. The load carrying belt 310 is mounted on rollers 320, 322 and is driven by roller 324 as is well-known in the art. Belt 310, which is of the same composition as the conveyor belt which has previously been described, has a friction surface which enables it to carry a load suitably along its surface. The round belts 318 and 318' are respectively mounted on downstream pulleys 326 which are mounted to shafts 328 by means of roller bearing assemblies 330. The belt is positioned by alignment pulleys 332 and 334 which are also rotatably mounted to shafts which are in turn secured to the frame or in case of pullies 326 and 332 to the steel slider bed 312. The round belts 318 and 318' are mounted on the outside of belt 310 around roller 322 and driver roller 324. Thus, it can be seen that rather than using the lower conveyor structure, which has previously been described, a round belt conveyor is utilized which engages only the outer edges of the film web wrapped around the conveyor assembly. In this embodiment there is a short distance of approximately two to three inches between the end of the downstream pulley 326 to the edge of roller 320 so that the web of film will engage to a slight extent the tip of the conveyor assembly. However, since the web is being carried forward, friction forces do not build up unlike those of prior art devices. The operation of the wrapping apparatus is the same as that of the preferred embodiment.

In the operation of the inventive wrapping apparatus, the full web, spiral web, and banding modes of operation are operated in a substantially identical manner. In these modes, a feed conveyor 12 brings the load 24 onto the wrapping conveyor assembly 14 which then carries the load to a predetermined wrap position within the film dispensing path and the conveyor assembly stops, leaving the load in a stationary position. The leading edge 57 of the film web 58 is held in clamping assembly 62 located beneath the conveyor assembly 14 as is best seen in FIG. 3. Rotation of ring 44 about the load is then begun.

As ring 44 rotates, film is drawn from film roll 56 across the surface of roller 74 to encircle the load. Thus, the rotation speed of roller 74 is established by the linear speed of the film web being wrapped on the load. Through gears 79 and 77, the rotation speed of upstream roller 72 is held to a constant ratio of that of downstream roller 74, so that when upstream roller 72 contacts film roll 56 and engages the film web, the film web is stretched during passage between the rollers due to the speed differential therebetween.

As ring 44 rotates, the contact of roller 63 with stationary ring 60 forces roller 63 to rotate, thereby rotating transfer gear 64. Clutch gear 65 meshes with transfer gear 64 and transfers energy to input plate 68 of constant torque device 67 through locking pin 66. The output plate 69 of constant torque device 67 supplies a constant torque to downstream roller 74 through roller shaft 75. Thus, the force experienced by the load in its effort to draw film across upstream roller 72 and downstream roller 74 is reduced, and the variations in speed required by the film web due to corner passage on the load is experienced without change in force on the film.

Alternatively, if the load is substantially cylindrical, the constant torque device 67 may be eliminated as described above, so that clutch gear 65 rotates roller 74 at a constant speed. The force experienced by the load in its effort to draw film across rollers 72 and 74 is again reduced, and speed variations are held to a minimum by the shape of the load.

As film payout reduces the diameter of film roll 56, the housing 76 is pivoted as noted above to maintain contact of upstream roller 72 with film roll 56. Simultaneously, gears 64 and 65 remain meshed and the torque supplied through constant torque device 67 remains constant regardless of the package size or rate of ring rotation.

After at least one wrap has been made around the load and the clamp assembly, the clamps are rotated releasing edge 57 which is held by the film web wrap. If the wrap is for a full web load as shown in FIG. 5 or a banded load as shown in FIG. 6, a plurality of overlying layers of film are wrapped around the load and the conveyor assembly 14. In the spiral wrap mode as shown in FIG. 7, a plural number of wraps are wrapped around the downstream end of the load as shown in phantom in FIG. 7 in the same manner as the banding in FIG. 6 and the conveyor assembly is activated carrying the load downstream to a take-off conveyor so that a spiral wrap is formed around the load. When the load reaches a station where the end is sensed by a feeler gauge, light sensing means, pressure sensitive switch or other suitable sensing mechanism, both the take-off conveyor and wrapping conveyor assembly stop and a second band is placed around the upstream end of the load in the same manner as if a band or full web wrap were being wrapped around the load. It should be noted that there is a space between the conveyor assembly 14 and the take-off conveyor 20 allowing the stretched film web to be discharged from the conveyor assembly and assume its memory position M around the load.

The end of the wrap cycle is determined in the present invention by a proximity switch located a short distance away from ring 44 which senses a bent metal plate secured to the ring. The proximity switch is electrically connected to a counter which is activated to determine each revolution of wrap. The particular counter which is utilized is an Eagle counter, Model D2100-AG, which is an off-the-shelf standard apparatus. When the counter has indicated a predetermined number of revolutions determined by the type of wrap and the load desired to be wrapped, the counter activates a switch which stops the take-off conveyor and wrapping conveyor assembly for cutting of the film web. The activation of the fluid cylinders to fire in a predetermined order and extend a predetermined distance is well known in the art and can be accomplished by common fluid circuitry. When the cutter mechanism is activated, the cutter standard and head is directed upward and abuts the film carrying the film to the middle of the load. It should be noted that the dispensing roll 56 on ring 44 in the stop position is located underneath the load and is substantially perpendicular to the axis of the load. When the film roll has been positioned in this manner, the web itself has engaged either the load edge or conveyor assembly edge and is angled from the edge down towards the roll positioned on the ring. The cutter mechanism 110 when driven upward by the pneumatic cylinder 118 engages the angled film web and carries it into substantial conformance with a perpendicular line drawn from the center axis of the conveyor assembly with the brush 128 brushing the film down over an underlying film layer wrapped around the conveyor assembly as is shown in FIG. 9. The clamping mechanism 62 is then rotated to clamp and hold the film web between the cutter head 120 and the dispensing roll 56. The pneumatic cylinder 122 of the cutting head is then fired, driving a sawtooth cutter blade 221 into the film web 58 to sever the film web. When the film web is severed, a small portion of the trailing edge is left hanging free from the wrap. If desired, this film edge may be wiped onto the load by firing the cutter standard cylinder 118 a second time so that the standard moves a short distance further on carrying the brush on to wipe the remnant edge against the wrap. The cutter standard is then withdrawn away from the load into a rest position as shown in phantom in FIG. 9 for the next cutting operation and the conveyors are activated to carry the wrapped load away from the wrapping station and a new load into the wrapping station.

In the continuous wrapping operation, the previously described cutter mechanism is not used and the loads are continuously carried along the wrapping conveyor assembly onto a take-off conveyor which spaces the loads for severing downstream. The loads are then severed between the spaced film areas as previously discussed and taken away to another transport area.

In the foregoing description, the invention has been described with reference to a particular preferred embodiment, although it is to be understood that the specific details shown are merely illustrative, and the invention may be carried out in other ways without departing from the true spirit and scope of the following claims:

What is claimed is:

1. An apparatus for making a unitary package using a single web of stretchable plastic material to form an overwrap, comprising: a frame; a dispenser means mounted to said frame, said dispenser means being adapted to hold and dispense a roll of stretchable material; drive means adapted to drive said dispenser means in rotation about a load; elongation means connected to said drive means and adapted to receive and engage stretchable material pulled from said dispenser means, said elongation means comprising at least a downstream roller and an upstream roller interconnected by speed control means; power assistance means coupled to said elongation means and driven by said drive means, said power assistance means comprising power transfer means and predetermined constant torque means adapted to produce a predetermined constant torque, said power transfer means being coupled through said predetermined constant torque means to said elongation means, said power transfer means comprising stationary ring means and friction roller means, said stationary ring means being secured to said frame, said friction roller means being coupled to said predetermined constant torque means and engaging said stationary ring means to rotate said friction roller means during rotation of said dispenser means about said load to provide said predetermined constant torque to said elongation means, said elongation means being driven by said power assistance means and by engagement of the stretchable material pulled from the dispenser means during rotation of the dispenser means about the load, said upstream and downstream rollers being acted upon by said speed control means so that said downstream roller transports said stretchable material faster than said upstream roller to cause said stretchable material to elongate between said upstream and downstream rollers.

2. Apparatus as claimed in claim 1 wherein said elongation means is adapted to maintain contact between said upstream roller and said roll of stretchable material during payout of said stretchable material.

3. Apparatus as claimed in claim 2 wherein said upstream roller and said downstream roller are adapted to maintain a constant distance between one another during payout of said stretchable material.

4. Apparatus as claimed in claim 1 wherein said predetermined torque means is coupled to said downstream roller.

5. Apparatus as claimed in claim 1 wherein said predetermined torque means is adjustable.

6. Apparatus as claimed in claim 1 wherein said speed control means comprises upstream gear means and downstream gear means, said upstream gear means being coupled to said upstream roller and said downstream gear means being coupled to said downstream roller, said gear means being meshed to define a constant speed ratio of said upstream roller to said downstream roller.

7. Apparatus as claimed in claim 1 wherein said predetermined torque means comprises a hysteresis clutch.

8. An apparatus for providing and overwrap to unitize a load by dispensing a stretchable film web to encompass the load, comprising: a frame, conveyor means attached to said frame, said conveyor means being adapted to carry said load through said frame; rotary ring means rotatably mounted to said frame; drive means adapted to drive said rotary ring means, dispenser means mounted to said rotary means, said dispenser means being adapted to hold and dispense a roll of stretchable film web; pre-stretch means mounted to said rotary ring means adjacent said dispenser means, upstream roller means and downstream roller means rotatably mounted to said pre-stretch means and rotated by engagement of the film web pulled form the dispenser during rotation of the dispenser about the load, speed control means connecting said upstream roller means and said downstream roller means so that said downstream roller means and upstream roller means rotate at a constant speed ratio such that said film web passed across said upstream roller means at a first speed and said downstream roller means at a second speed higher than said first speed; stationary ring means mounted to said frame in coaxial relationship with said rotary ring means; and power assistance means connected to said pre-stretch means and having means engaging said stationary ring means to produce constant predetermined torque from rotation of said rotary ring means and said engaging means relative to said stationary ring means and means to transmit said predetermined torque to said roller means.

9. Apparatus as claimed in claim 8 wherein said power assistance means comprises power transfer means and predetermined torque means, said power transfer means comprising contact roller means, said contact roller means being mounted to said pivot axle in contact with said stationary ring means; said predetermined torque means comprising an adjustable predetermined torque means having an input plate and an output plate, said contact roller being adapted to transfer power during rotation of said rotary ring means to said input plate, said output plate being adapted to transmit predetermined torque to said downstream roller.

10. Apparatus as claimed in claim 8 wherein said power assistance means is adjustable to alter said predetermined torque.

11. Apparatus as claimed in claim 8 including wrapping conveyor means adapted to support said load within said rotary ring and carry said load and said film web encircling said load and said wrapping conveyor means away from said rotary ring means.

12. Apparatus as claimed in claim 11 wherein said wrapping conveyor means comprises upper conveyor means and lower conveyor means, said upper conveyor means having an uppermost surface adapted to carry said load in a first direction at a first conveyor speed, said lower conveyor means having a lowermost surface adapted to carry said overwrap in said first direction at said first conveyor speed.

13. Apparatus as claimed in claim 8 wherein said power assistance means comprises power transfer means and predetermined torque means, said power transfer means being coupled to said predetermined torque means, and said predetermined torque means being coupled to said pre-stretch means.

14. Apparatus as claimed in claim 13 wherein said predetermined torque means is coupled to said downstream roller means.

15. Apparatus as claimed in claim 13 wherein said predetermined torque means comprises adjustable predetermined torque means.

16. Apparatus as claimed in claim 14 wherein said power transfer means comprises friction roller means, said friction roller means being coupled to said pre-stretch means and engaging said stationary ring means to rotate said friction roller means during rotation of said rotary ring means about said load.

17. Apparatus as claimed in claim 13 including transfer gear means coupling said power transfer means to said predetermined torque means.

18. Apparatus as claimed in claim 15 wherein said adjustable predetermined torque means comprises a hysteresis clutch.

19. An apparatus for making a unitary package by dispensing a web of stretchable film web to form an overwrap, comprising: a frame; fixed track means fixedly mounted to said frame; ring means rotatably mounted to said frame; a dispenser means mounted to said ring means, said dispenser means being adapted to hold and dispense a roll of stretchable film web; said ring means providing rotation of said dispenser means about a load; elongation means mounted to said ring means and adapted to receive and engage unstretched film web from said dispenser means, said elongation means comprising at least a downstream roller and an upstream roller, said elongation means being adapted to transport said film web across said downstream roller at a varying downstream speed substantially proportional to a speed at which said film web is wrapped about said load, said upstream roller being adapted to transport said film web at an upstream speed which is a fixed fraction of said variable downstream speed so that said film web is stretched between said upstream and downstream rollers; predetermined torque means mounted on said ring means and adapted to produce a predetermined constant torque, said predetermined torque means being connected to said elongation means and having engaging means engaging said fixed track means, said elongation means being driven by said predetermined constant torque, derived from said engaging means as it and said predetermined torque means are rotated along said track means, and by engagement of the film web pulled from the dispenser means during rotation of the ring means about the load, and drive means adapted to drive said rotary ring means and said predetermined torque means.

20. An apparatus for wrapping a load with a stretched film web to form an overwrap, comprising: rotary ring means; dispenser means mounted to said rotary ring means, said dispenser means being adapted to dispense film web; said rotary ring means being rotatable to provide rotation of said dispenser means about a load; elongation means connected to said rotary ring means and adapted to receive film web pulled from said dispenser means, said elongation means comprising speed control means and at least a downstream roller and an upstream roller closely spaced apart and interconnected by said speed control means; power assistance means coupled to said elongation means, said elongation means being driven by said power assistance means and by engagement of said film web pulled from said dispenser means, said power assistance means comprising power transfer means and predetermined torque means, said power transfer means comprising stationary ring means and contact roller means, said contact roller means being coupled to said predetermined torque means and engaging said stationary ring means to rotate said contact roller means during rotation of said rotary ring means; said predetermined torque means comprising power input means coupled to said contact roller means and adapted to receive rotational power therefrom, and torque output means adapted to produce a predetermined constant torque, said torque output means being coupled to said elongation means.

21. Apparatus as claimed in claim 20 wherein said predetermined torque means comprises a hysteresis clutch.

22. Apparatus as claimed in claim 20 including transfer gear means, said contact roller means being coupled through said transfer gear means to said power input means.

23. Apparatus as claimed in claim 20 wherein said speed control means comprises upstream gear means and downstream gear means, said upstream gear means being coupled to said upstream roller and said downstream gear means being coupled to said downstream roller, said downstream roller being adapted to rotate at a variable speed and said speed control means being adapted to rotate said upstream roller at a fixed fraction of said speed of said downstream roller.

24. Apparatus as claimed in claim 20 wherein said predetermined torque means is coupled to said downstream roller.

25. Apparatus as claimed in claim 20 including wrapping conveyor means comprising upper conveyor means and lower conveyor means, said upper conveyor means having an uppermost surface adapted to carry said load in a first direction at a first conveyor speed through said rotary ring means and said stationary ring means, said lower conveyor means having a lowermost surface adapted to carry said overwrap in said first direction at said first conveyor speed through said rotary ring means and said stationary ring means.

* * * * *